US008791887B2

(12) United States Patent
Smith et al.

(10) Patent No.: US 8,791,887 B2
(45) Date of Patent: Jul. 29, 2014

(54) METHOD OF COMPENSATING FOR CAPACITANCE OF A PROGRAMMING LINE OF AN OLED DISPLAY

(75) Inventors: Euan Smith, Longstanton (GB); Aleksandra Rankov, Huntingdon (GB); Barry Thompson, Menlo Park, CA (US)

(73) Assignee: Cambridge Display Technology Limited, Cambridgeshire (GB)

( * ) Notice: Subject to any disclaimer, the term of this patent is extended or adjusted under 35 U.S.C. 154(b) by 504 days.

(21) Appl. No.: 13/058,711

(22) PCT Filed: Aug. 13, 2009

(86) PCT No.: PCT/GB2009/001990

§ 371 (c)(1),
(2), (4) Date: Apr. 12, 2011

(87) PCT Pub. No.: WO2010/018380

PCT Pub. Date: Feb. 18, 2010

(65) Prior Publication Data

US 2011/0181630 A1 Jul. 28, 2011

(30) Foreign Application Priority Data

Aug. 15, 2008 (GB) ..... 0814931.2

(51) Int. Cl.
*G09G 3/32* (2006.01)

(52) U.S. Cl.
USPC ..... 345/78

(58) Field of Classification Search
USPC ..... 345/76–78, 82–83
See application file for complete search history.

(56) References Cited

U.S. PATENT DOCUMENTS 4,539,507 A 9/1985 VanSlyke et al.
7,012,586 B2 * 3/2006 Kageyama et al. ..... 345/77

(Continued)

FOREIGN PATENT DOCUMENTS

CA 2 495 715 A1 7/2006
EP 0 717 446 A2 6/1996

(Continued)

OTHER PUBLICATIONS

Dawson et al., "The Impact of the Transient Response of Organic Light Emitting Diodes on the Design of Active Matrix OLED Display," IEEE International Electron Device Meeting, pp. 32.6.1-32.6.4 (1998).

(Continued)

*Primary Examiner* — Allison W Johnson
(74) *Attorney, Agent, or Firm* — Marshall, Gerstein & Borun LLP

(57) ABSTRACT

This invention relates to active matrix OLED (Organic Light Emitting Diode) displays, in particular to display panels with integrated negative capacitance circuits and to active capacitance compensation. We describe an active matrix OLED display comprising a glass panel bearing a plurality of lines of OLED pixels, each with an associated active matrix driver circuit having a programming connection for programming a brightness of the associated OLED, programming connections of a line of pixels being connected to a programming line of said display, and wherein said active matrix OLED display further comprises a plurality of capacitors on said glass panel, each having a first plate connected to an end of a respective said programming line and having a second plate for connecting to a negative capacitor circuit to compensate for a capacitance of said programming line.

13 Claims, 7 Drawing Sheets

(56) References Cited

U.S. PATENT DOCUMENTS

| | | | | |
|---|---|---|---|---|
| 2003/0030630 | A1 | 2/2003 | Bayot et al. | |
| 2004/0140763 | A1* | 7/2004 | Buchwalter et al. | 313/506 |
| 2004/0201556 | A1 | 10/2004 | Oomori et al. | |
| 2005/0068275 | A1 | 3/2005 | Kane | |
| 2006/0208961 | A1 | 9/2006 | Nathan et al. | |

FOREIGN PATENT DOCUMENTS

| | | | |
|---|---|---|---|
| EP | 1 071 070 | A2 | 1/2001 |
| WO | WO-90/13148 | A1 | 11/1990 |
| WO | WO-95/06400 | A1 | 3/1995 |
| WO | WO-99/21935 | A1 | 5/1999 |
| WO | WO-99/42983 | A1 | 8/1999 |
| WO | WO-99/48160 | A1 | 9/1999 |
| WO | WO-01/26087 | A1 | 4/2001 |
| WO | WO-02/067343 | A1 | 8/2002 |

OTHER PUBLICATIONS

Shim et al., "Acceleration of Current Programming Speed for AMOLED using Active Negative-Capacitance Circuit," 14th International Display Workshops, pp. 1985-1986 (Dec. 2007).

Shim et al., "Late-News Paper: Fast Current-Programming Method of OLED," *SID Symposium Digest of Technical Papers, Society of Information Display*, 39(1):105-108 (May 2008).

Shirisaki et al., "Solution for Large-Area Full-Color OLED Television—Light Emitting Polymer and a-Si TFT Technologies," Casio Computer Co., Ltd. and Kyushu University, 11th International Display Workshops, pp. 275-278 (Dec. 2004).

Combined Search and Examination Report for Application No. GB0814931.2, dated Dec. 4, 2008.

International Preliminary Report for Application No. PCT/GB2009/001990, dated Feb. 15, 2011.

International Search Report and Written Opinion for Application No. PCT/GB2009/001990, dated Jan. 15, 2010.

* cited by examiner

METHOD OF COMPENSATING FOR CAPACITANCE OF A PROGRAMMING LINE OF AN OLED DISPLAY

FIELD OF THE INVENTION

This invention relates to active matrix OLED (Organic Light Emitting Diode) displays, in particular to display panels with integrated negative capacitance circuits. Aspects of the invention also relate to methods and apparatus for active capacitance compensation in OLED displays, with particular (but not exclusive) applicability to passive matrix displays.

BACKGROUND TO THE INVENTION

Organic light emitting diodes (OLEDs) comprise a particularly advantageous form of electro-optic display. They are bright, colorful, fast-switching, provide a wide viewing angle and are easy and cheap to fabricate on a variety of substrates. Organic (which here includes organometallic) LEDs may be fabricated using materials including polymers, small molecules and dendrimers, in a range of colors which depend upon the materials employed. Examples of polymer-based OLEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507.

Organic LEDs may be deposited on a substrate in a matrix of pixels to form a single or multi-color pixellated display. A multicolored display may be constructed using groups of red, green and blue emitting sub-pixels. So-called active matrix (AM) displays have a memory element, typically a storage capacitor, and a transistor associated with each pixel (whereas passive matrix displays have no such memory element and instead are repetitively scanned to give the impression of a steady image). Examples of polymer and small-molecule active matrix display drivers can be found in WO 99/42983 and EP 0,717,446A, respectively.

Active matrix displays can be classified as either current programmed or voltage programmed, according to whether light emission levels are set by supplying data to pixels (through column or data lines) either as a current signal or as a voltage signal, respectively.

Background prior art relating to voltage-programmed active matrix driver circuits can be found in "The impact of the transient response of organic light emitting diodes on the design of active matrix OLED display" (Dawson et al, IEEE International Electron Device Meeting, San Francisco, Calif., 875-875, 1998). Background prior art relating to current-programmed active matrix pixel driver circuits can be found in "Solution for Large-Area Full-Color OLED Television—Light Emitting Polymer and a-Si TFT Technologies" (Shirisaki et al, of Casio Computer Co Ltd and Kyushu University, Invited paper AMD3/OLED5-1, 11$^{th}$ International Display Workshops, 8-10 Dec. 2004, IDW '04 Conference Proceedings pp. 275-278, 2004).

FIGS. 1*a* and 1*b*, which are taken from the IDW '04 paper, show an example current programmed active matrix pixel circuit and a corresponding timing diagram. In operation, in a first stage the data line is briefly grounded to discharge Cs and the junction capacitance of the OLED (Vselect, Vreset high; Vsource low). Then a data sink Idata is applied so that a corresponding current flows through T3 and Cs stores the gate voltage required for this current (Vsource is low so that no current flows through the OLED, and Ti is on so T3 is diode connected). Finally the select line is de-asserted and Vsource is taken high so that the programmed current (as determined by the gate voltage stored on Cs) flows through the OLED ($I_{OLED}$).

The brightness of an OLED is determined by the current flowing through the device, this determining the number of photons it generates. An active matrix pixel circuit therefore must provide a means of controlling such a current through an OLED device. The setting of this current can be through the means of either a current or voltage programming signal. Voltage programming has the advantage of simplicity and speed but requires a reproducible relationship between the set voltage and the delivered current, a relationship which often changes with time. A current programmed circuit will copy the current onto the OLED and therefore does not rely on any indirect relationship and is therefore less prone to changes with panel age, however, current-programming methods exhibit longer settling times (charging times) due to the relatively large parasitic capacitance of the data lines.

"Acceleration of Current Programming Speed for AMOLED using Active Negative-Capacitance Circuit" (C.-H. Shim and R. Hattori, 14$^{th}$ International Display Workshops, December 2007, IDW '07 Conference Proceedings pp. 1985-1986, 2007) proposes the concept of "negative capacitance" to eliminate the effects of panel parasitic capacitance by implementing an equivalent circuit which has the same value as a parasitic capacitance but the opposite sign. FIGS. 2*a* and 2*b*, which are taken from the Shim and Hattori paper, show a simplified equivalent circuit of pixel driving transistor, parasitic capacitance, and negative capacitor for AMOLED, as well as a conceptual diagram of an implemented active negative feedback circuit. It is also known to pre-charge a display column.

There is, however, a need for improved techniques.

SUMMARY OF THE INVENTION

Active Matrix Displays

According to a first aspect of the invention there is therefore provided an active matrix OLED display, the display comprising a glass panel bearing a plurality of lines of OLED pixels, each pixel comprising an OLED and an associated active matrix driver circuit, each said active matrix driver circuit including a programming connection for programming a brightness of the associated OLED, programming connections of a line of said OLED pixels being connected to a programming line of said display, and wherein said active matrix OLED display further comprises a plurality of capacitors on said glass panel, each having a first plate connected to an end of a respective said programming line and having a second plate for connecting to a negative capacitor circuit to compensate for a capacitance of said programming line.

In some preferred embodiments the capacitor is connected to an opposite end of a programming (column) line to an external connection to the programming line. This facilitates routing of an external programming connection since this external connection need not be routed past the capacitor. However in other embodiments a capacitor is provided at either end of the programming line. This is advantageous since not only is the current (charge) delivered by the capacitor halved, also the effective resistance is halved since each capacitor is delivering current to only half the column line, thus resulting in a four-fold performance improvement.

In some preferred embodiments the negative capacitor circuits are also fabricated on the glass panel of the display. However in alternative configurations a said negative capacitor circuit may be fabricated in a chiplet which is attached, for example printed onto, the glass panel. Example printing technology can be found at www.semprius.com.

Broadly speaking the capacitor of a negative capacitor circuit aims to deliver charge equal to that stored in the capacitance of the programming line. For a programming line capacitance $C_{line}$ the current flow is $C_{line}$ (dV/dt). The capacitance of the programming line is in the main that from the input capacitance of the source/drain connections of the select transistor of each pixel driver circuit to the programming line. In some preferred embodiments the negative capacitor circuit comprises an amplifier with an input coupled to one plate of a said capacitor and an output coupled to the other plate of the capacitor. However the skilled person will understand that more complex circuits may be employed, for example a circuit in which a dV/dt term is explicitly generated, passed to an amplifier and the output of the amplifier used to control a current generator injecting current onto the programming line.

In some preferred embodiments the negative capacitor circuit employs transistors only of an NMOS type. Some preferred embodiments employ an LTPS (low temperature polysilicon) process, which enables self-aligned gates to be employed in the active matrix pixel driver circuits, which have a reduced input capacitance (patterned gate metal in amorphous silicon typically requires some overlap to allow for tolerances and hence has a larger input capacitance).

In some particularly preferred embodiments the negative capacitor circuit includes circuitry to compensate for a threshold voltage change in one or more of the transistors of the circuit, due to ageing. In some embodiments the negative capacitor circuit comprises a current mirror providing a current source or sink to a long-tailed transistor pair, with a diode-connected transistor in the output transistor of the transistor pair. In such an arrangement the main preference for compensating threshold voltage changes ($V_T$) is in the transistors of the long-tailed pair. A number of different circuit configurations may be employed, for example depending upon the trade off between available circuit area, complexity and degree of compensation applied.

In some preferred embodiments the capacitor of a negative capacitor circuit has a value of between 1/20 and 2 times the capacitance of the programming line. This facilitates accurate compensation of the programming line capacitance since it reduces the risk of the negative capacitor circuit being unable to deliver the current needed to compensate the positive, real capacitance. If insufficient current is delivered, for example because of a supply voltage limitation, then because the compensation relies upon a dV/dt term the compensation does not recover from such a limitation.

In a related aspect the invention provides a method compensating for capacitance of a programming line of an active matrix OLED display, the display comprising a glass panel bearing a plurality of lines of OLED pixels, each pixel comprising an OLED and an associated active matrix driver circuit, each said active matrix driver circuit including a programming connection for programming a brightness of the associated OLED, programming connections of a line of said OLED pixels being connected to a programming line of said display, the method comprising driving each said programming line using a negative capacitor circuit including a respective capacitor to supply charge to compensate for said capacitance of said programming line, locating said capacitors in a border portion of said glass panel of said display.

In a further related aspect the invention provides a circuit for use in an AMOLED display, the display comprising a glass panel and a plurality of programming lines on the panel, the circuit comprising a capacitance means and an amplifying means coupled to the capacitance means, such that, in operation, said capacitance means and said amplifying means provide a negative capacitance to a said programming line, wherein at least said capacitance means is disposed within a boundary of the glass panel.

Active Capacitance Compensation

We now describe further techniques which may be employed in both active matrix and passive matrix displays, these techniques employing a reference capacitor to track to the degree of charge to be applied to compensate for display capacitance. The techniques are especially suitable for passive matrix displays which may have a capacitance of 1-2 nF per column and several hundred columns. In such cases the physical size of the capacitance in a negative capacitance circuit as described above can be a problem. We therefore describe techniques in which a small internal reference capacitor is employed to track the amount of active charging of the capacitance of a programming line taking place, in order to compensate for charge lost from the drive current source.

According to a further aspect of the invention there is therefore provided a method of compensating for capacitance of a programming line of an OLED display when driving the OLED display, the method comprising: using a reference capacitance to mimic said capacitance of said programming line; and driving both said programming line and said reference capacitance in tandem responsive to a comparison between a voltage on said programming line and a voltage on said reference capacitor.

Embodiments of this technique facilitate a more accurate and adaptable compensation for display capacitance. More particularly in embodiments a smaller peak current output is required from the compensation circuit and a smaller charge-storing capacitor may be used.

Embodiments of the method recognise recognize that the effect of the programming line capacitance may be compensated by tracking the initial and final voltage of the line and using this to determine, in effect, a charge for the line (from capacitance times the difference in voltage). Using a reference capacitance provides a mechanism for remembering the difference in voltage, and hence for determining what charge has previously been applied to the programming line so that the additional charge (current) needed can be determined.

The technique enables the reference capacitor to be just a fraction of the capacitance of the programming line, for example less than 1/10, 1/20, 1/50 or 1/100 of the programming line capacitance, with a corresponding reduction in the physical size of the reference capacitor.

In embodiments the method is implemented using a circuit comprising a comparator with a first input connected to the programming line and a second input connected to the reference capacitor, and having an output controlling current generators generating currents for the reference capacitor and for the programming line respectively, preferably matched, preferably in a ratio of the reference capacitance to the programming line. By driving both the reference capacitor and programming line capacitance in tandem the voltage on the reference capacitor in effect tracks, and hence determines the charge needed, to compensate for the programming line capacitance. With such an arrangement a mechanism, such as a diode forward conducting from an inverting input to a non-inverting input of the comparator may be employed to pull the voltage on the reference capacitor down to discharge this at the same time as the programming line capacitance (the diode conducting) if the voltage on the programming line (capacitance) is less than the voltage on the reference capacitor.

Such an arrangement can, under certain circumstances, give rise to positive feedback in which an increase of voltage on the programming line drives an increase of voltage on the reference capacitor and vice-versa. Embodiments of the circuit/method may therefore include a system to reduce such instability due to positive feedback, for example by arranging for the voltage on the programming line capacitance always to be slightly less than that on the reference capacitance and/or arranging for the drive to the programming line capacitance to slightly lag that to the reference capacitor. The skilled person will understand that other techniques may also be employed, for example deliberately introducing a slight mismatch in the current drives to the programming line and reference capacitance.

In embodiments the current drive to the reference capacitance is much smaller than that to the programming line (since the reference capacitance has a much smaller capacitance value). Thus the current drive to the reference capacitance may have a duty cycle of less than 100% (where 100% denotes always on). Preferably the respective current drives to the programming line and reference capacitance are matched in the ratio of their respective capacitance values. The skilled person will recognise that there are many ways for achieving this, some examples being described later.

In a related aspect the invention provides a system for compensating for capacitance of a programming line of an OLED display when driving the OLED display, the system comprising: means for using a reference capacitance to mimic said capacitance of said programming line; and means for driving both said programming line and said reference capacitance in tandem responsive to a comparison between a voltage on said programming line and a voltage on said reference capacitor.

In a further aspect the invention provides an OLED display driver for compensating a capacitance of a programming line of an OLED display, the OLED display driver including a capacitance compensation circuit, wherein said capacitance compensation circuit comprises a reference capacitance, a comparator having a first input coupled to said reference capacitance and a second input coupled to a connection for said programming line and an output, a first current driver for providing a first current drive to said programming line and a second current driver for providing a second current drive to said reference capacitance, and first and second devices both driven by said output of said comparator, such that, in use, charge injected from said first current drive into said programming line compensates for said capacitance of said programming line.

In preferred embodiments of these techniques the OLED display is a passive matrix display.

BRIEF DESCRIPTION OF THE DRAWINGS

These and other aspects of the invention will now be further described, by way of example only, with reference to the accompanying figures in which.

Broadly speaking, we will describe techniques for moving the point of introduction of a negative capacitor circuit, for overcoming the effects of the column capacitance on programming times, from a driver chip, where it may not be practical to implement, to an active matrix display panel.

Compared to current-programming schemes, the described techniques achieve a much-reduced programming time, thus making the schemes more practical for larger panel sizes. Compared to other demonstrations of negative capacitance with respect to an OLED display panel, the typical implementation of negative capacitance requires either a significantly sized capacitor and/or a large voltage range. It is not possible to integrate economically such a large capacitance on a driver chip, and allowing the voltage to increase beyond the silicon process used would drastically increase cost.

In related developments, we also describe techniques for using a reference capacitor to track the amount of charge required to compensate for display capacitance.

Compared to standard pre-charging schemes, the described techniques provide more accurate and adaptable compensation for display capacitance, while compared to negative capacitance a smaller peak current output from the circuit and a smaller stored capacitor is achieved.

Active Matrix Displays

Turning first to aspects of mitigating the effects of the column capacitance on programming times in active matrix displays, a negative capacitance circuit is an active circuit which exhibits an opposite current-voltage (I-V) response to a capacitor. For a capacitor, $$I = C\frac{dV}{dt}.$$

To make a negative capacitor this relationship is inverted, such that $$I = -C\frac{dV}{dt}.$$

The capacitance on a data line reduces how quickly the voltage will settle on a line for a given drive, be that a current or voltage drive. Adding an equal and opposite negative capacitance, if perfectly implemented, could result in the negative capacitance circuit automatically supplying all the current needed to change the charge state of the line capacitance appropriately. In other words, it can cancel out the capacitance present, drastically shortening the settle time and therefore the programming time. A limiting factor to the success of this scheme is the track resistance. However, even given this limiting factor, the negative capacitance is capable of substantially reducing the settle time during programming.

Figure 3:
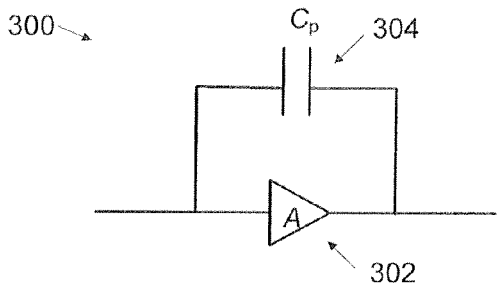
FIG. 3 shows an example of a negative capacitance circuit according to an embodiment of an aspect of the invention.

A basic negative capacitance circuit 300 is shown in FIG. 3, and comprises a non-inverting op-amp 302 with a capacitor 304 between the input and output of op-amp 302. The capacitance response of the circuit will be $C_p(1-A)$, where A is the gain of the op-amp. Therefore, if A>1 then the capacitance will be negative. In principle it would be possible for small signals to have a high A and therefore produce a big negative capacitance using a small real capacitor. For larger signals the effect of the high gain could cause the output of the op-amp to hit the voltage rails and stop working correctly. More typically the circuit is preferably designed with a gain of around 2.

Figure 4:
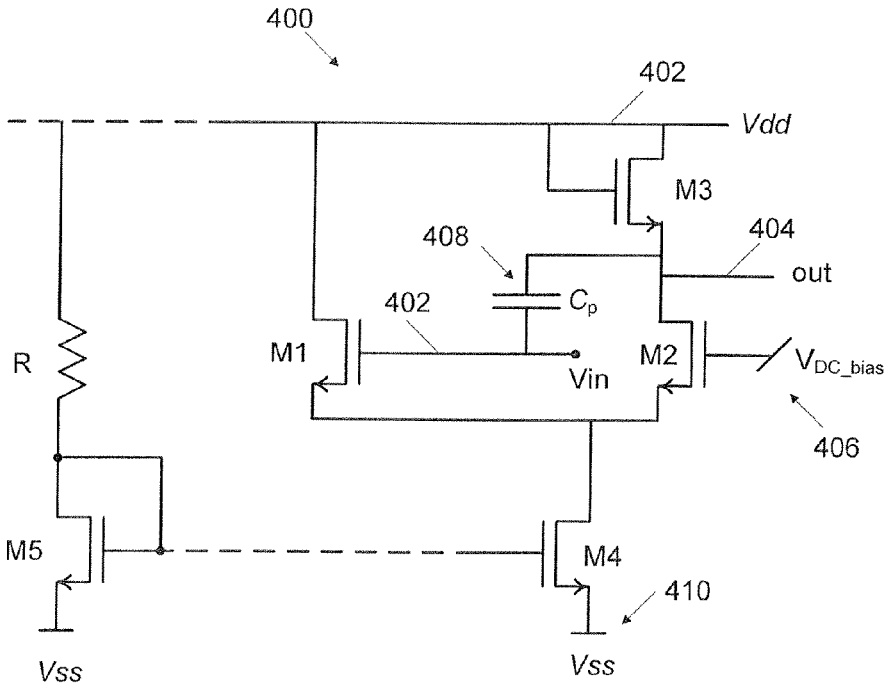
FIG. 4 shows an example of a negative capacitance circuit according to an embodiment of an aspect of the invention.

FIG. 4 shows an exemplary negative capacitance circuit. The circuit 400 includes an op-amp comprising transistors M1, M2, M3, M4, where load transistor M3 is coupled to Vdd line 402. Transistor M3 need not be implemented in configurations where available headroom is limited. Transistors M1 and M2 form a differential input pair tied to a single voltage supply Vin by means of bias voltage ($V_{DC_bias}$) 406. The input Vin is coupled to one plate of a capacitor 408 with an output 404 coupled to the other plate of the capacitor 408. The depicted circuit also includes a current mirror providing a current source or sink (VSS) 410 to a long-tailed transistor pair M4, M5, with diode-connected transistor M5 as the output transistor of the transistor pair.

In the circuit depicted in FIG. 4, all transistors are n-channel TFTs so this circuit would be suitable for implementation in amorphous silicon. However, the skilled person will appreciate that alternative designs using p-channel only could also be possible.

Furthermore, for implementation on s-Si, additional circuitry could be required to set up this circuit to compensate for the threshold voltage drifts which could develop on the devices. For implementation on low temperature polysilicon (LTPS), care may need to be taken to ensure that the effects of TFT nonuniformity do not unduly inhibit the operation of the circuit, and additional circuitry to compensate for these effects may be incorporated.

It would also be possible to implement the transistor components in silicon chiplets printed on the panel, in which case the capacitor would stay on the panel. In this case the circuit could preferably be implemented in CMOS (n and p channel devices).

Figure 5A:
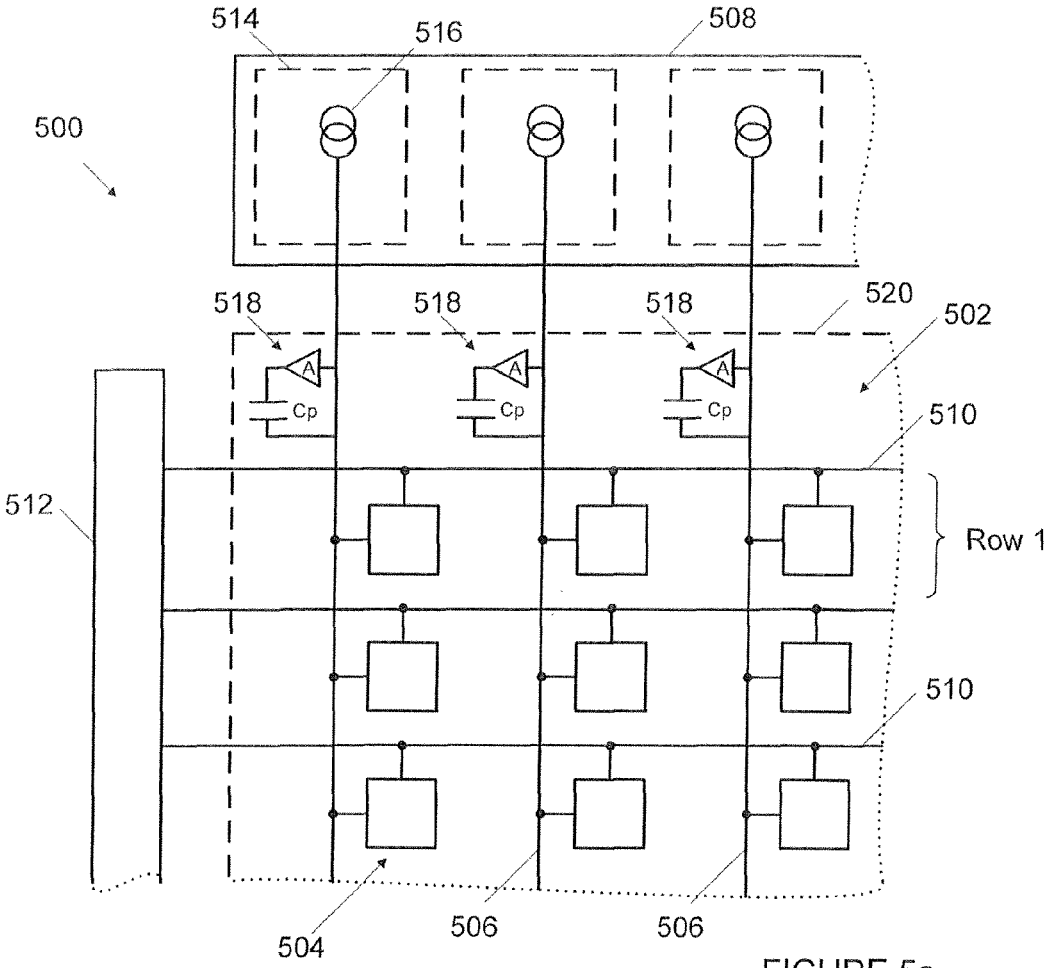
FIGS. 5*a* to 5*c* show schematic diagrams of active matrix OLED display circuitry according to embodiments of the present invention.
Figure 5B:
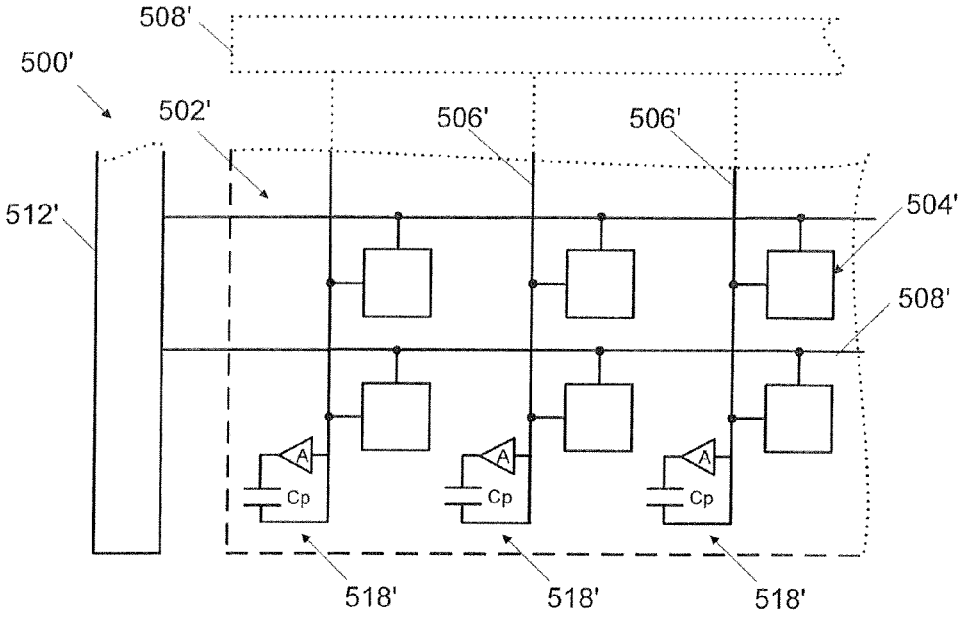
Figure 5C:
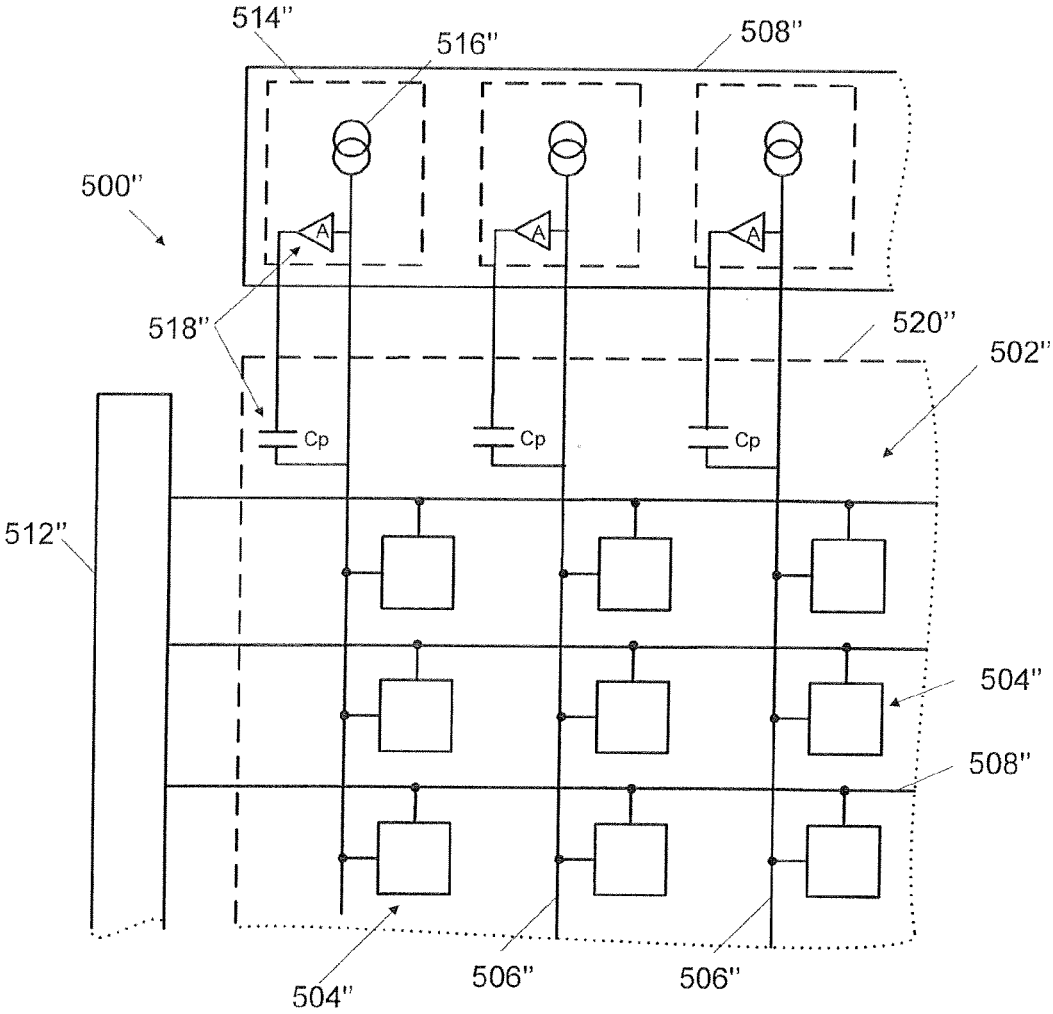

The negative capacitance circuit depicted in FIGS. 3 and 4 may be implemented in numerous ways in an AMOLED display, examples of which are provided in FIGS. 5*a* to 5*c*.

Figure 1A:
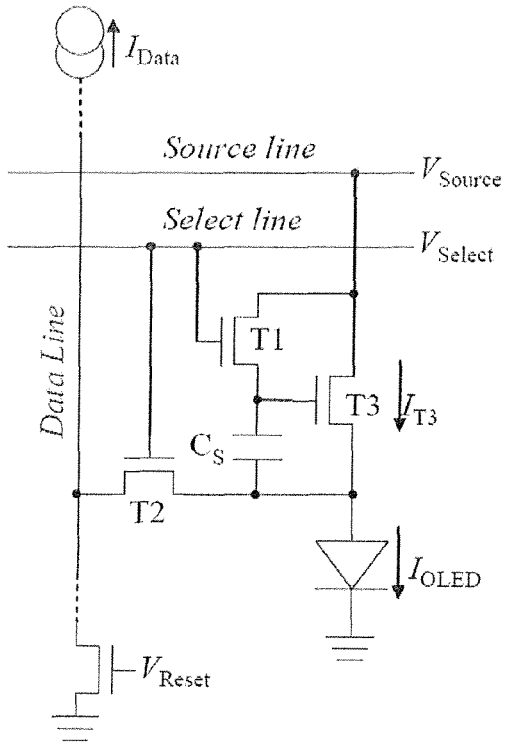
FIGURE 1a (PRIOR ART)
FIGS. 1*a* and 1*b* show an example of a pixel circuit according to the prior art and a corresponding timing diagram.
Figure 1B:
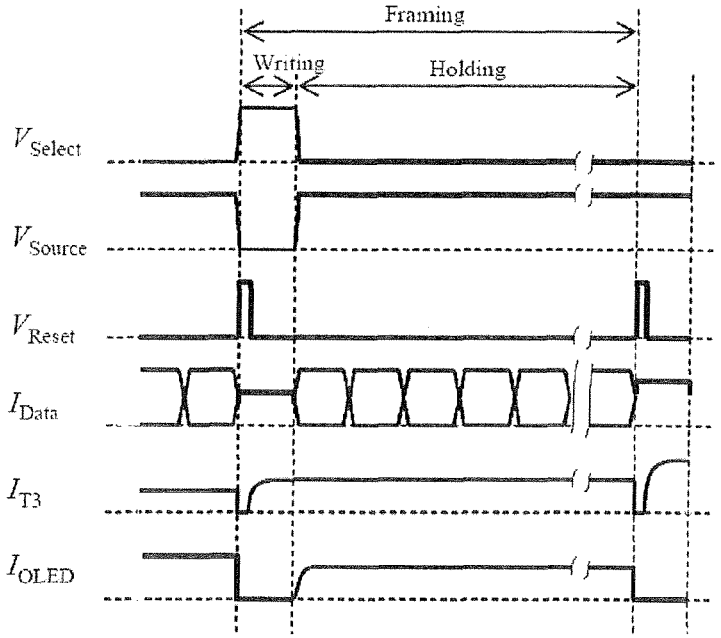
FIGURE 1b (PRIOR ART)
Figure 2A:
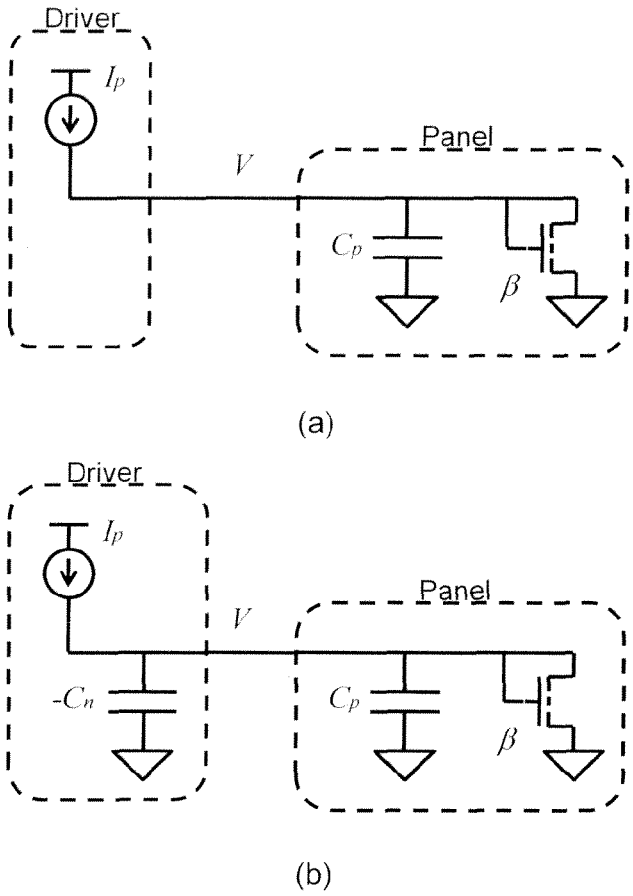
FIGURE 2a (PRIOR ART)
FIGS. 2*a* and 2*b* show, respectively, an equivalent circuit of pixel driving transistor, parasitic capacitance, and negative capacitor for AMOLED, and an implemented circuit of active negative-capacitance feedback according to the prior art.
Figure 2B:
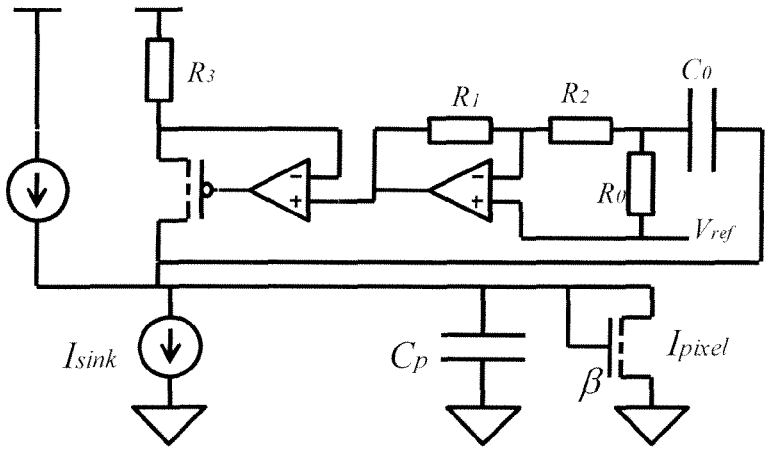
FIGURE 2b (PRIOR ART)

In FIG. 5*a*, an active matrix OLED display 500 having an M row by N column array of current programmed active matrix pixel circuits 504 on a glass panel 502 is shown. For clarity, only nine pixel circuits are shown, though the structure and operating principle of display 500 can be readily ascertained. Each active matrix pixel circuit 504 could comprise a circuit similar to that described with reference to FIG. 1*a* for example, though any suitable active matrix pixel circuit could be implemented alternatively. Each active matrix pixel is connected to a column (data) line 506 driven by column driver 508, and a row (select) line 510 driven by row driver 512. Here, the column driver 508 includes column control circuitry 514 including a current source 516 for each column.

In the specific embodiment shown in FIG. 5*a*, both the op-amp, A, and the corresponding capacitor, Cp, of each negative capacitance circuit 518 (one for each column line 506) are connected to a column line 506 on glass panel 502 between an edge 520 of the glass panel 502 adjacent to the column driver 508 and active matrix pixel circuits of a first row (Row 1) of the array.

In another specific embodiment depicted in FIG. 5*b*, in which like reference numbers designate like or corresponding parts as those of FIG. 5*a*, both the op-amp, A, and corresponding capacitor, Cp, of each negative capacitance circuit 518' (one for each column line 506'), are connected to an end of a column line 506' on glass panel 502' which is opposite to that of the connection between the column line 506' and the column driver 508'.

FIGS. 5*a* and 5*b* present simplified schematics of AMOLED displays, in which the space between columns may be measurable in microns, e.g 150 μm, while the space between the active area and the edge of the glass panel may be measurable in millimetres. However, it will be appreciated that the implementation of negative capacitance circuits may depend, among other things, on the size, complexity (layout) and material selection choices made for the display panel. For example, a staggered geometry of negative capacitance circuits might be implemented.

Since the combined capacitance of a column generally comprises the sum of all the parasitic capacitances of the elements connected to that column, e.g. a combined capacitance value of about 100 pF with a current source of about 1 μA, the use of negative capacitance circuits may become more attractive as the display panel size (and hence the number of pixel circuits and capacitance) increases. The spatial resolution of some video formats are given below:

| Display Format | Spatial resolution (pixels) |
|---|---|
| WQVGA | 428 × 240 |
| HVGA | 480 × 320 |
| WVGA | 854 × 480 |
| HD720 | 1280 × 720 |
| HD1080 | 1920 × 1080 |

In view of the fact that a limiting factor for implementing the described negative capacitance scheme is the track resistance, in another specific embodiment of an active matrix display according to the present invention, a negative capacitance circuit is provided at either end of the column line. Such a configuration would not only halve the current (charge) delivered by each capacitor, but also reduces the effective resistance since each capacitor is delivering current to only half the column line.

It may also be desirable to implement negative capacitance circuitry for AMOLED displays adopting patterning technologies in which source/drain-gate overlap occurs with a concomitant increase in input capacitance. This may be less of an issue for AMOLED displays using self-aligned processes.

In FIG. 5*c*, which depicts another specific embodiment of an active matrix display 500" according to the present invention, the capacitor, Cp, of each negative capacitance circuit 518" is supplied on the glass panel 502" while the corresponding op-amp, A, is incorporated in the column driver 508", for example in each column control circuit 514". Such an implemenation may require a doubling of the connection count from the driver to the panel, which may substantially increase the cost. However, this configuration still has the benefit of the other implementations of having the bulky component (the capacitor) on the glass with the ability to design the capacitor size to correctly match the column line capacitance, with the benefit of high quality.

In a further specific embodiment of an active matrix display according to the present invention, the negative capacitance circuits could be distributed throughout the display panel.

In yet another specific embodiment, the negative capacitor circuits could be fabricated in a chiplet which is attached, for example printed onto, the glass panel. More complex negative capacitance circuits are also possible, for example where a differentiator calculates the signal required based on the change in voltage and this is then used to drive a current source. Such circuits could also be potentially implemented on the glass.

Active Capacitance Compensation

Turning now to aspects of active charge compensation, it will be appreciated that, while the following description is presented in the context of passive matrix displays, the underlying concepts can equally be applied to active matrix displays.

Larger OLED passive matrix displays have a large of amount of capacitance (from other OLEDs) that needs to be driven in parallel with the OLED device or devices that are active on a given column. If V0 is the initial voltage state of a column, V1 is the voltage state during steady-state driving and $C_{col}$ is the capacitance of the column, then at the start of an addressing phase a quantity of charge equal to $C_{col}$(V1−V0) can be used to charge up the column line before the OLED itself is driven. This represents a loss of signal which needs to be compensated for. One method to do so is to voltage pre-charge, whereby a voltage source is connected to the column line for a set time.

Such an approach is acceptable but fails to account for the charge required to go from the nominal pre-charge voltage to the drive voltage, particularly as the OLED ages and the drive voltage increases. While negative capacitance methods compensate adaptively to a large degree, initially a very high current output may be required which either may require a large output device or, if the device is limited, there is likely to be a mismatch between the required current and the actual current supplied for charging which will still leave a charge error.

Figure 6:
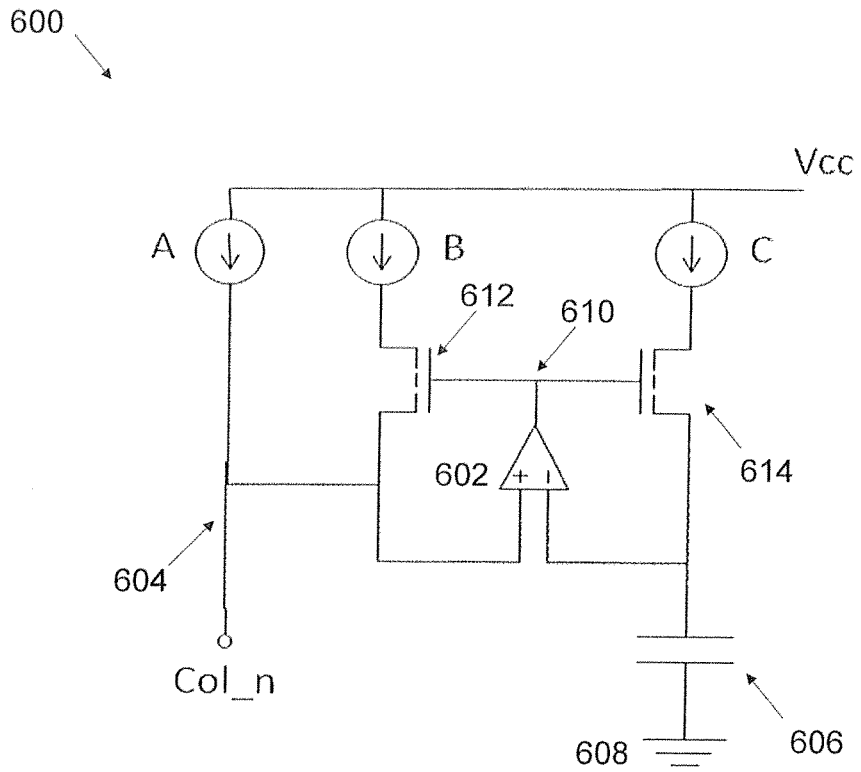
FIG. 6 shows an example of an active charge compensation circuit according to an embodiment of an aspect of the invention.

The circuit shown in FIG. 6 proposes employs a different approach for compensating for column charging effects. The circuit 600 comprises a column driver A, a column charging source B, and a reference source C which is smaller than, but scaled to, the charging source B. A comparator 602 comprising an op-amp having a first input connected to programming line 604 and a second input connected to a reference capacitor 606 provides an output 610 to transistors 612, 614 of a current mirror configuration. If IB is the charging source current, IC is the reference source current, $C_{col}$ is the column capacitance and $C_{ref}$ is the reference capacitance, then the currents and reference capacitance may be chosen such that $$\frac{IB}{IC} = \frac{C_{col}}{C_{ref}}.$$

The operation of the circuit is then as follows:

The column (Col_n) starts at V0 and the reference capacitor 606 will be charged to the same voltage;

The column driver A supplies current to the display, intended for the OLED, which initially goes to charging the column capacitance;

The column capacitance charges increasing the column voltage above V0;

The difference in the column voltage and the voltage on $C_{ref}$ causes the comparator to switch and the B and C current sources to be connected;

Current source B supplies current to the column to compensate for the current from A which has gone to charging the column rather than driving the OLED. As B drives onto the column, so C drives onto the reference capacitor 606;

B and C will continue supplying current while the column voltage is higher than the voltage on $C_{ref}$;

When the voltages match, then B and C will be disconnected;

Once the drive voltage, V1, is reached then the charge which has gone into the column capacitance is equal to $C_{col}$ (V1−V0);

The charge supplied into the reference capacitor is $C_{ref}$ (V1−V0);

The charge supplied by B into the column is $$\frac{IB}{IC} \times C_{ref}(V1 - V0); \text{ and}$$

Substituting in the design relationship $$\frac{IB}{IC} = \frac{C_{col}}{C_{ref}}$$

gives the charge supplied by B as $C_{col}$(V1−V0). In other words, B has supplied all the charge needed for charging up the column, therefore all the charge supplied by A has gone to driving the OLED.

This method compensates accurately for column charging effects and removes the need for a discrete pre-charge phase, therefore providing more time to drive the OLED pixels.

The issue of discharge will now be discussed briefly. In particular, when the column is discharged, a means is also preferably provided to similarly discharge the reference capacitor. This could be simply provided via either a diode between the reference capacitor and the column line, or by providing a switch to the discharge line for the reference capacitor the same way one is provided for the column line.

If the diode method is used it may need to be ensured that the comparitor will take into account the diode built-in voltage, i.e. the capacitor would discharge to (for example) V0+0.6V, so the comparitor in this particular case would need to be designed such that 8 will switch off once the reference capacitor is 0.6V above the column line.

It will be apparent that the principle behind this circuit could be achieved in other ways. The primary aim is to supply a charge equal to $C_{col}$(V1−V0), regardless of the voltage difference experienced. Thus, an alternative could be to measure the voltage (for example digitally) and then to supply the appropriate additional current. Other, more complex, implementations involving op-amps could also be possible. However, the underlying design considerations remain the same, which is that a circuit may be provided which supplies a charge to the column line proportional to the voltage difference, as opposed to a negative capacitance circuit which supplies a current dependent on the rate of change of voltage.

Other modifications to the circuit could resolve some of the issues of very small current sources (the C current source), for example using a higher current output source and duty-cycling the output to reduce the time averaged current. Another example would be to use a single current source for B and C and time share it between the reference capacitor and the column line.

Some means to match $$\frac{IB}{IC} = \frac{C_{col}}{C_{ref}}$$

may also preferably be implemented as the driver will need to cope with difference display devices. One possibility could be to use an external resistor to set the levels of one or both of these devices. Another could be to duty cycle one or both of these devices to get the correct time-averaged ratio. Finally, another approach could be to adjust the ratio of time sharing of a single current source between the two outputs.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of compensating for capacitance of a programming line of an organic light emitting diode (OLED) display when driving the OLED display, the method comprising:

using a reference capacitance to mimic said capacitance of said programming line; and driving both said programming line and said reference capacitance in tandem responsive to a comparison between a voltage on said programming line and a voltage on said reference capacitance, wherein said driving comprises supplying a compensating current to be added to a drive current on the programming line depending on the comparison.

2. A method as claimed in claim 1 further comprising discharging said reference capacitance towards a voltage on said programming line to reduce a drive on said programming line.

3. A method as claimed in claim 1 further comprising controlling said driving to reduce instability due to positive feedback between said capacitance of said programming line and said reference capacitance.

4. A method as claimed in claim 1 wherein said capacitance has a capacitance of less than 1/10 of said capacitance of said programming line.

5. A method as claimed in claim 1 wherein said driving comprises controlling respective current drives to said reference capacitance and to said programming line, wherein the respective current drive to said programming line provides the compensating current.

6. A method as claimed in claim 5 wherein said controlling of said current drive to said reference capacitance comprises applying a current drive to said reference capacitance with a duty cycle of less than 100%.

7. A method as claimed in claim 5 wherein said controlling of said respective current drives includes matching a current drive to said reference capacitance to a current drive to said capacitance of said programming line in a ratio of a capacitance of said reference capacitance to said capacitance of said programming line.

8. A method as claimed in claim 1 wherein said OLED display comprises a active matrix OLED display.

9. A method as claimed in claim 1 wherein said driving comprises using a comparator to perform said comparison and using said comparator to control respective switching devices switching current generators supplying said reference capacitance and said programming line.

10. A method as claimed in claim 1 wherein said capacitance has a capacitance of less than 1/20 of said capacitance of said programming line.

11. A method as claimed in claim 1 wherein said capacitance has a capacitance of less than 1/50 of said capacitance of said programming line.

12. A method as claimed in claim 1 wherein said capacitance has a capacitance of less than 1/100 of said capacitance of said programming line.

13. A method as claimed in claim 1 wherein said OLED display comprises a passive matrix OLED display.

* * * * *